United States Patent [19]

Wieder et al.

[11] 4,045,067

[45] Aug. 30, 1977

[54] APPARATUS AND METHOD FOR HANDLING GARMENT HANGERS

[76] Inventors: Rodney L. Wieder, P.O. Box 86, R.D. No. 1, Coopersburg, Pa. 18036; Michael A. Neetz, 2433-Apt. 105, Prospect Ave., Allentown, Pa. 18103; Earl O. Sell, 53 Buckeye Road, Emmaus, Pa. 18049

[21] Appl. No.: 737,474

[22] Filed: Nov. 1, 1976

[51] Int. Cl.[2] ..... A47G 25/06

[52] U.S. Cl. ..... 294/15; 224/45 T

[58] Field of Search ..... 294/1 R, 5.5, 15, 25, 294/26; 224/42.1 CA, 42.45 A, 42.46 A, 45 R, 45 P, 45 Q, 45 T; 248/339, 340

[56] References Cited

U.S. PATENT DOCUMENTS

| | | | |
|---|---|---|---|
| 2,782,974 | 2/1957 | Borgfeldt | 224/45 T |
| 3,162,473 | 12/1964 | George | 294/5.5 |
| 3,226,147 | 12/1965 | Marshall | 294/15 |
| 3,606,967 | 9/1971 | Roberts | 224/45 T |

*Primary Examiner*—Johnny D. Cherry
*Attorney, Agent, or Firm*—Amster & Rothstein

[57] ABSTRACT

A method and an apparatus are provided from handling a plurality of garment hangers as a unit for mounting and dismounting on the bars of garment racks and for transportation therebetween. The apparatus includes a handle for carrying the apparatus and a scooping member joined to the handle and having a hanger hook-receiving surface which is generally parallel to and spaced from the handle. In addition, the hanger hook-receiving surface is inclined with respect to a plane parallel to the handle and intersecting both the handle and the receiving surface. To remove garment hangers from a bar, the apparatus is positioned so that the receiving surface is disposed below and is inclined downward and away from the open portions of the hanger hooks. The entire apparatus is then raised upwards so that the hanger hooks slide down the receiving surface and are securely supported therefrom. The hangers may then be carried wherever necessary. The garment hangers are replaced on a supporting bar by lowering the apparatus down to the bar to bring the hook openings directly over it. The apparatus is then moved downward and outward through the hanger hook openings, thereby leaving the hangers supported on the bar.

6 Claims, 3 Drawing Figures

APPARATUS AND METHOD FOR HANDLING GARMENT HANGERS

The present invention relates generally to the handling and transportation of garment hangers of the type including a supporting hook, and, more particularly, this invention concerns a method and apparatus for handling a plurality of garment hangers as a unit for removal and replacement on the hanger supporting bars of clothing racks.

It is a common practice in the garment industry for manufacturers to mount certain articles, such as shirts and blouses, on garment hangers and to ship them to retail establishments in bulk, with the hangers included with the garments. Upon receipt at the retail establishment, the hangered garments are, typically, hung out on a first garment rack immediately upon being unpacked. In the process of being placed on display for customers, large groups of hangered garments may have to be moved from the first garment rack to other garment racks. If the hangered garments are transferred from one rack to another by hand, they are usually transferred individually or a few at a time. The high labor cost occasioned by the slowness of this process makes this stage of handling the garments inordinately expensive. Moreover, a large number of hangered garments are not conveniently handled by hand. Attempts to do so often result in accidents and injuries to the workers' fingers, resulting from the weight of the hangers and garments. A device which could conveniently be used by workers to handle a plurality of hangered garments as a unit would eliminate these safety hazards and would result in substantial savings in time, labor and money in the handling of the garments.

Devices are known in the prior art which are capable of handling a plurality of garment hangers as a unit for removal and replacement on the bar of a clothing rack. For example, such a device is disclosed in U.S. Pat. No. 3,226,147, issued to J. H. Marshall on Dec. 28, 1965. The disclosed device includes a handle and a spring wire loop, which is affixed to one side of the handle and is detachably connected to the other side of the handle, to form a generally rectangular shape. The wire loop is spring-loaded, so that, when its detachable end is disconnected from the handle (open position), it is biased away from the handle and there is a space between the handle and the detachable end of the wire loop. To simultaneously remove a plurality of hangers from a bar, the device is held by means of the handle and is operated to hook the wire loop around the bases of the hanger hooks at a point below the bar. The wire loop is then connected to the handle (closed position) and the hangers are removed from the bar by lifting the handle upwardly. The hangered garments may then be transported about as a unit and can subsequently be replaced on the same or a different garment rack bar.

Although a device of the type described can be used to handle groups of hangered garments, it is not practical or convenient for use in a commercial environment. When large quantities of garments must be moved, the hanger-handling device must be used repeatedly, and the time and effort expended opening and closing the prior art device becomes a substantial factor in the efficiency of operation. Substantial savings in time, labor and costs could be realized if the operations of opening and closing the hanger-handling device were eliminated. Furthermore, the described prior art device is impractical for removing a group of hangered garments from the middle of a bar filled with garments, because of the difficulty of hooking the wire loop around a few hanger hooks disposed in the middle of a row of such hooks.

Broadly, it is an object of this invention to improve the efficiency of handling garment hangers for mounting and dismounting on garment racks and for transportation therebetween. Specifically, it is within the contemplation of this invention to provide a method and apparatus for handling a plurality of garment hangers as a unit in order to increase the efficiency of the stated operations, and to save time and money.

It is another object of this invention to provide an apparatus for handling a plurality of hangers as a unit for removal and replacement on the supporting bars of garment racks, which apparatus requires no adjustments during use.

It is a further object of this invention to provide a device for handling a plurality of garment hangers as a unit for removal and replacement on the bars of garment racks, which apparatus can efficiently and effectively remove a group of hangers mounted anywhere along a long row of hangers.

It is also an object of this invention to provide a device which meets the aforementioned objectives and which is reliable, efficient and convenient in use, yet inexpensive in construction and low in cost.

It is an additional object of this invention to provide a method for operating an apparatus of the type described which is rapid and efficient, and includes no unnecessary, time-consuming steps.

In accordance with an illustrative embodiment demonstrating objects and features of the present invention, there is provided an apparatus for handling a plurality of garment hangers as a unit for mounting and dismounting on the bars of garment racks and for transportation therebetween. The apparatus includes a handle for carrying the apparatus and a scooping member joined to the handle and having a hanger hookreceiving surface which is generally parallel to and spaced from the handle. In addition, the hanger hook-receiving surface is inclined with respect to a plane parallel to the handle and intersecting both the handle and the receiving surface. To remove garment hangers from a bar, the apparatus is positioned so that the receiving surface is disposed below and is inclined downward and away from the open ends of the hanger hooks. The entire apparatus is then raised upwards, with the result that the hanger hooks slide down the receiving surface and are securely supported therefrom. Thus supported, the hangers may be carried wherever necessary. The garment hangers are replaced on a supporting bar by lowering the apparatus down to the bar to bring the hook openings directly over it. The apparatus is then moved downward and outward through the hanger hook openings, thereby leaving the hangers supported on the bar.

The foregoing brief description, as well as further objects, features and advantages of the present invention will be more completely understood from the following detailed description of a presently preferred, but nonetheless illustrative, embodiment of the invention, with reference being had to the accompanying drawings wherein.

Figure 1:
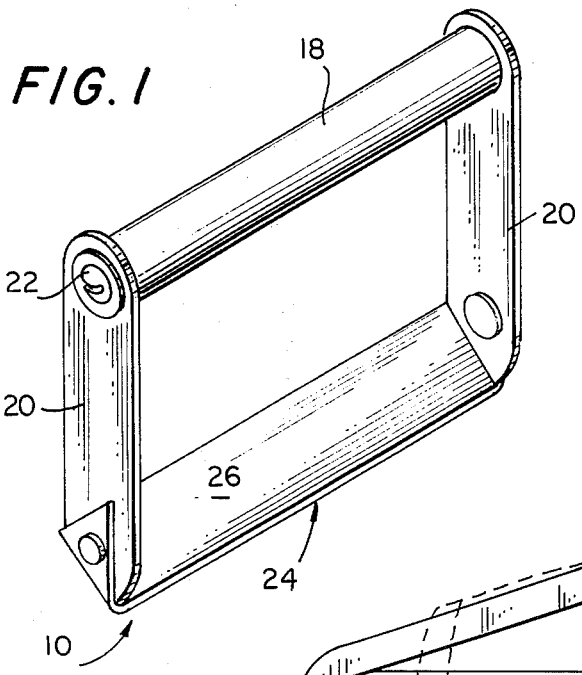
FIG. 1 is a perspective drawing of a hanger-handling apparatus in accordance with the present invention.

Referring now, generally, to the details of the drawing, there is shown a hanger-handling apparatus 10 which is used with a plurality of garment hangers 12 to handle the hangers as a unit for:removal from the supporting bar 14 of of a garment rack 16; transportation; and replacement on supporting bar 14 or another supporting bar.

Apparatus 10 includes a generally cylindrical handle 18, preferably made of wood, A pair of depending supporting members 20, preferably made of steel strap about one inch wide and one-eighth of an inch thick, are secured at either end of handle 18 by means of screws 22, or the like. A scooping member 24 is mounted to the supports 20 at the end opposite handle 18 by means of rivets, welding, or the like. Scooping member 24 is, preferably, also made of strap steel about one inch wide and one-eighth of an inch thick, and is mounted to be parallel to the handle 18 and to be inclined at an angle of about 45° with respect to the longitudinal center lines of the supports 20. As a result of the foregoing construction, scooping member 24 has a hanger hook-receiving surface 26 which is spaced from the handle 18, is parallel to it, and is inclined with respect to a plane including the axis of handle 18 and intersecting surface 26. It will be appreciated that the described device has a sturdy, but relatively inexpensive, construction.

Figure 2:
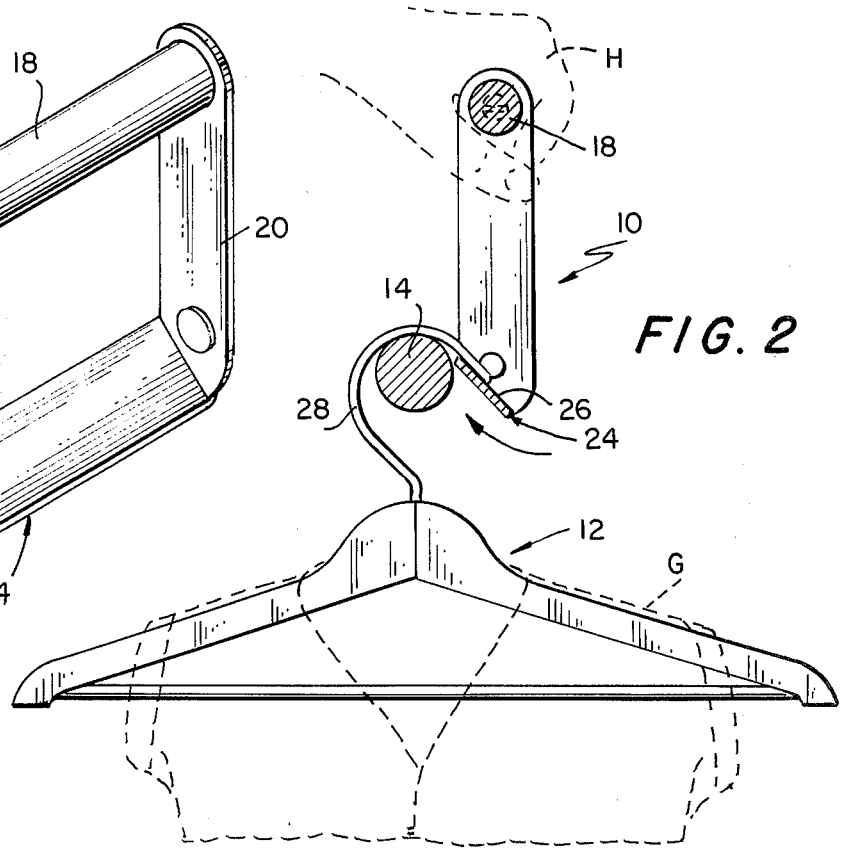
FIG. 2 is a side elevational view, on a reduced scale, with parts sectioned to show the hanger-handling apparatus positioned under the hooks of hangers, supported on a bar, just prior to removing the hangers from the bar.
Figure 3:
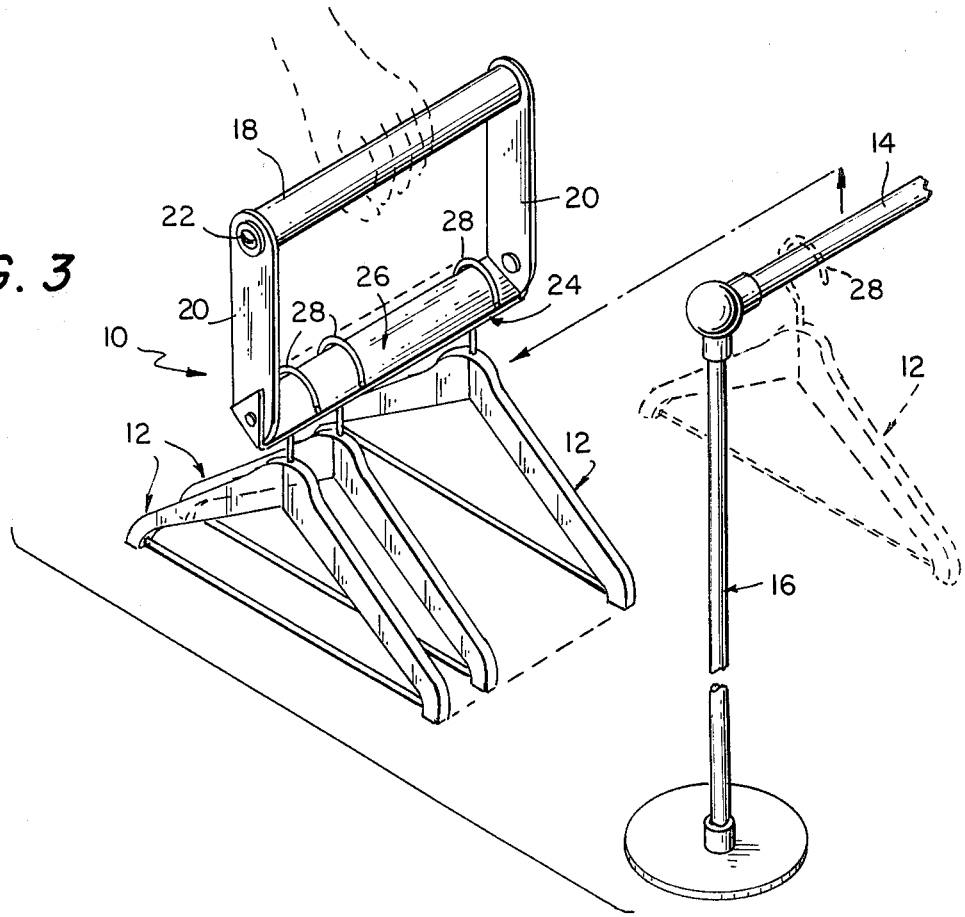
FIG. 3 is a perspective drawing, on a reduced scale, showing a plurality of hangers being transported just after removal from or prior to replacement on a supporting bar.

Referring now to FIG. 2, there are shown garment hangers 12 with garments G mounted thereon, which hangers are supported by means of their hanger hooks 28 from a bar 14. To remove the hangers from the bar 14, apparatus 10 is held in the hand H of an operator and is positioned so that receiving surface 26 of scooping member 24 is below the front (open) portion of the hanger hooks 28. Apparatus 10 is then raised upwardly, as indicated by the arrow in FIG. 2, to engage the lower edges of hooks 28. As apparatus 10 is raised, hooks 28 slide down the inclined surface 26 until they come to rest on scooping member 24. By continuing the described movement of the apparatus 10, the operator can bring the hangers 12 clear of the bar 14, and may transport them wherever he wishes, as shown in FIG. 3.

The hangers 12 may be replaced on bar 14, or another bar, by bringing hanger hooks 28 to a position directly over the bar 14 and lowering the apparatus 10 to mount the hanger hooks 28 on the bar. Apparatus 10 is freed from the hanger hooks 28 by continuing the downward movement of hangle 18 so that the undersurface of scooping member 24 slides along bar 14 and is moved outward and through the open portion of the hanger hooks 28. Apparatus 10 may then be used immediately for handling a new group of hangers.

From the foregoing description, it will be appreciated that the apparatus 10 can be used repeatedly without making any adjustments to it. As a result, the hanger-handling process is sped up and made more efficient with accompanying savings in time, labor and costs. It will also be recognized that the apparatus 10 is capable of removing a group of hangers disposed anywhere along a long line of hangers on a rack, because the hanger hooks 28 are accessed from underneath rather than from the side as in the prior art. The number of hangers removed will, of course, depend on the length of the handle 18 and scooping member 26. It has been found that an apparatus having an overall length of about 18 inches can simultaneously accommodate over four dozen hangered garments.

Although specific embodiments of the invention have been disclosed for illustrative purposes, it will be appreciated by those skilled in the art that many additions, substitutions, and modifications are possible without departing from the scope and spirit of the invention as disclosed by the accompanying claims. For example, inclined receiving surface 26 need not be planar. It could, for example, be curved (e.g., convex or concave when seen in section as in FIG. 2), parallel to handle 18, and oriented so that its surface normals are inclined with respect to a plane parallel to handle 18 and intersecting both handle 18 and surface 26.

What is claimed is:

1. A device for handling garment hangers of the type including a supporting hook adapted to be hung on a generally horizontal supporting bar in a garment rack, said device being useful for handling a plurality of hangers as a unit for mounting and dismounting on supporting bars and transportation therebetween, said device comprising:

a handle for holding said device;

a scooping member including a hanger hook-receiving surface generally parallel to said handle and spaced therefrom, said hook-receiving surface having surface normals inclined with respect to a plane parallel to said handle and intersecting both said handle and said hook-receiving surface; and means for joining said handle and said scooping member in a spaced relationship;

said device being used to dismount a plurality of garment hangers from a supporting bar by holding said device with said hook-receiving surface below and inclined downward away from the open portion of said hanger hooks, and lifting said device so that said hanger hooks slide down said hook receiving surface and are simultaneously lifted from said bar, said hangers being placed on a bar by lowering said device towards and below said bar so that said hanger hooks engage said bar.

2. The device of claim 1 wherein said scooping member is made of a sturdy sheet material.

3. The device of claim 1 wherein said hook-receiving surface lies entirely in a plane which is inclined with respect to a plane intersecting said handle and said scooping member.

4. The device of claim 3 wherein said scooping member is made of a sturdy sheet material.

5. The apparatus of claim 4 wherein said handle is generally cylindrical and has its axis parallel to said hook receiving surface.

6. A method of removing, from a generally horizontal supporting bar, a plurality of garment hangers incorporating hanger hooks, said method employing a device including a handle, and a scooping member generally parallel to said handle and joined thereto in spaced relationship, said method comprising the steps of:

holding said device so that said scooping member is aligned with and below the open portion of said hanger hooks; and lifting said device so that said hanger hooks slide onto said scooping member and are simultaneously lifted from said bar;

said hangers being simultaneously replaced on a supporting bar by lowering said device towards and below said bar so that said hanger hooks engage said bar.

* * * * *